United States Patent [19]

Phillips

[11] Patent Number: 4,550,846

[45] Date of Patent: Nov. 5, 1985

[54] NON-STICK STOPPER WITH EASY REMOVAL STRUCTURE

[76] Inventor: Edwin D. Phillips, 700 Cedar Ave., Middlesex, N.J. 08846

[21] Appl. No.: 596,383

[22] Filed: Apr. 3, 1984

[51] Int. Cl.[4] ..... B65D 39/04

[52] U.S. Cl. ..... 215/296; 215/355

[58] Field of Search ..... 215/296, 299, 302, 305, 215/355; 215/296, 355

[56] References Cited

U.S. PATENT DOCUMENTS

| | | | |
|---|---|---|---|
| 339,556 | 4/1886 | Johnston | 215/296 |
| 2,526,622 | 10/1950 | Martin | 215/47 |
| 3,661,184 | 5/1972 | Lachenmayer | 215/355 X |
| 3,842,790 | 10/1974 | Clark | 215/228 |
| 3,900,122 | 8/1975 | Dichter | 215/31 |
| 4,008,820 | 2/1977 | Ruetz | 215/256 |
| 4,391,779 | 7/1983 | Miskinis | 422/99 |

FOREIGN PATENT DOCUMENTS

| | | | |
|---|---|---|---|
| 67788 | 3/1958 | France | 215/355 |

*Primary Examiner*—Steven M. Pollard

*Attorney, Agent, or Firm*—Shoemaker and Mattare, Ltd.

[57] ABSTRACT

A non-stick stopper with easy removal structure includes a device having an integral body with an upper portion for use in removing the stopper and a lower portion of special configuration for relatively non-compressive sealing with a tapered neck of a glass container. In one embodiment of the invention, an elongated pin handle is inserted through a traversely extending aperture in the body upper portion for use of a tool and/or a user's hand for ease in removing the stopper from the container. The tool is specially configured with a U-shaped recess bottle engaging portion at one end of an elongated handle. The U-shaped stopper engaging portion has double recesses from either side thereof so that the tool can be used with both the first embodiment and the second embodiment of the invention.

The second embodiment involves an inverted cone-shaped stopper having a radially extending stopper removing flange at one end thereof and a further conical closure structure at the other end thereof. The same tool as used for easy removal in the first embodiment can be used with this embodiment merely by reversing same 180° from its original position.

9 Claims, 5 Drawing Figures

NON-STICK STOPPER WITH EASY REMOVAL STRUCTURE

BACKGROUND OF THE INVENTION

1. Field of the Invention

This invention relates generally to stopper devices, and especially to a stopper designed so that it may be easily removed from the neck of a container with which it is used.

2. Description of the Prior Art

There are several problems with the design of the tapered stoppers which are in use today. One of these problems is due to temperature changes. When the temperature of the stopper and bottle is reduced, the difference in coefficient of expansion of the Teflon is much greater than that of the glass bottle. As the temperature is reduced, the difference in shrinkage between the Teflon and glass will allow the stopper to drop further into the taper of the bottle, and thereafter when the temperature is restored to normal room temperature, the stopper expands but cannot push itself up to its original position in relation to the taper. The expansion of the Teflon causes the stopper to be much tighter in the bottle neck than originally, and as a result it can become impossible to remove the stopper when the temperature difference is large. Furthermore, if the expansion of the Teflon is extreme, it can even break the glass container.

Another major cause of tight stoppers is due to the material in the bottle. When some of the material is removed from the container, the liquid must contact the tapered sealing portion of the bottle, and when the stopper is replaced, a film of liquid remains between the tapered surfaces. Depending upon the material in the container and the length of time between the next removal of the stopper, oxidation, evaporation, and other actions can cause the material to act as a glue, thus preventing the stopper from being removed.

A further problem with known-type stopper devices is that they are not normally designed for easy removal with a supplemental removal tool. By using such a supplemental tool with a specially designed stopper, the force needed to remove same from a container with which it is used can be substantially reduced.

Existing known prior patents which may be pertinent to this invention are as follows:

J. R. L. Martin, U.S. Pat. No. 2,526,622, 10/24/50
J. A. Clark, U.S. Pat. No. 3,842,790, 10/22/74
H. Dichter, U.S. Pat. No. 3,900,122, 8/19/75
J. Ruetz, U.S. Pat. No. 4,008,820, 2/22/77
R. J. Miskinis, U.S. Pat. No. 4,391,779, 7/5/83.

These patents generally show stoppers for sealing narrow neck bottles and containers in a secure manner.

U.S. Pat. No. 2,526,622 to Martin shows a bottle sealing stopper, especially in cross-section in FIG. 2, having a cone 13 which functions as a resilient spring to push outwardly upon the inner walls of the stopper body 10. Thus, the conical spring member 13 effectively urges body 10 radially outwardly in all directions so as to perform an extremely efficient sealing function. To remove the device, a fingernail or other object is inserted below the shoulder 11 and the stopper lifted upwardly.

The patent to Clark, U.S. Pat. No. 3,842,790, discloses another elastic closure member and also a tool for assisting in insertion and extraction of the closure member from the neck of a container. While the concept of this invention is similar to that of the present one, the specific structure for effecting same is substantially different therefrom.

The Dichter patent, U.S. Pat. No. 3,900,122, shows a stopper 11 having a resilient plug portion 12 which widens conically 14 towards the neck of the container and then tapers inwardly 15 therefrom. The cross-sections shown in FIGS. 1–3 best depict the features of this patent.

Ruetz U.S. Pat. No. 4,008,820 shows another stopper of plastic material having a gripping portion 1 and a substantially cylindrical sealing portion 2. The sealing portion 2 includes a cylindrical sealing wall 7 and a centering member 8 adjacent thereto, with the walls of the gripping portion, the centering member and the sealing wall all being laterally deformable. Again, the purpose of this patent is somewhat similar to that of the present invention, but the structure for effecting same is different.

The Miskinis patent, U.S. Pat. No. 4,391,779, shows a stopper 10 made with a Teflon body 12 with a retracting nut 22 threadably mounted on one end of the body for assisting in removing the stopper from a narrow neck container.

None of the above-listed patents teaches applicant's new and novel invention.

SUMMARY OF THE INVENTION

The purpose of this invention is to eliminate the possibility of an expanding stopper from producing sufficient force to break a glass container it is being used with, and to reduce the wedging action so that it is easier to remove. Another purpose is to provide a removal tool for those unusual conditions where both the wedging action and the contained material have combined to glue the stopper into the container.

An object of the present invention is to provide an easily removable, non-stick stopper with removal structure included therewith so that the stopper can be easily disengaged from a tapered neck of a container with which it is being used.

Another object of the present invention is to provide a stopper made of Teflon material having a conical tapered portion with flexible resilient walls designed so that even though the stopper may be permanently wedged into a narrow neck container, it can be relatively easily removed therefrom. Also, a tool for ease of removal of the stopper is part of the invention.

A further object of the present invention is to provide a plastic stopper having flexible sealing walls of conical shape supported from a head portion by further flexible conical walls, and with the head portion receiving a handle for aid in removing the stopper from a container.

A still further object of the present invention is to provide a stopper having conical sealing surface walls ending in a further tapered closed end and with the open end of the sealing surface walls provided with an extending flange portion for ease in removing the stopper from a container. The extending flange also provides a large area for engagement by a tool which is a further part of the invention.

The present invention has a number of new and novel features. There are two primary embodiments of the invention. The first embodiment has a head portion of solid construction with an aperture therethrough for receiving a handle pin therethrough. Extending from the head portion is a conical diverging resilient wall for supporting an inwardly tapered conical sealing surface wall. The sealing surface wall is preferably of generally the same configuration as a tapered neck glass bottle container for which the stopper is designed to be used. The dual flexible conical walls permit the stopper to be removed relatively easily from the container, and also prevents the stopper from exerting very much of a radial force against the inner surface of the container neck. The handle pin also permits handy gripping by a user for removal of the stopper and/or use of an accompanying tool for pivotable wedging action and removal of the stopper from the container.

Another embodiment has a stopper having a reversed central cone with conical tapering walls of resilient construction ending in a closed further conical end for adding strength to the overall stopper. An outwardly extending flange at the open end of this stopper permits easy removal of same from a container with which it is used by either a user's hand and/or a stopper removal tool. The same tool as in the first embodiment can be used because of the specific design arrangement of the tool.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
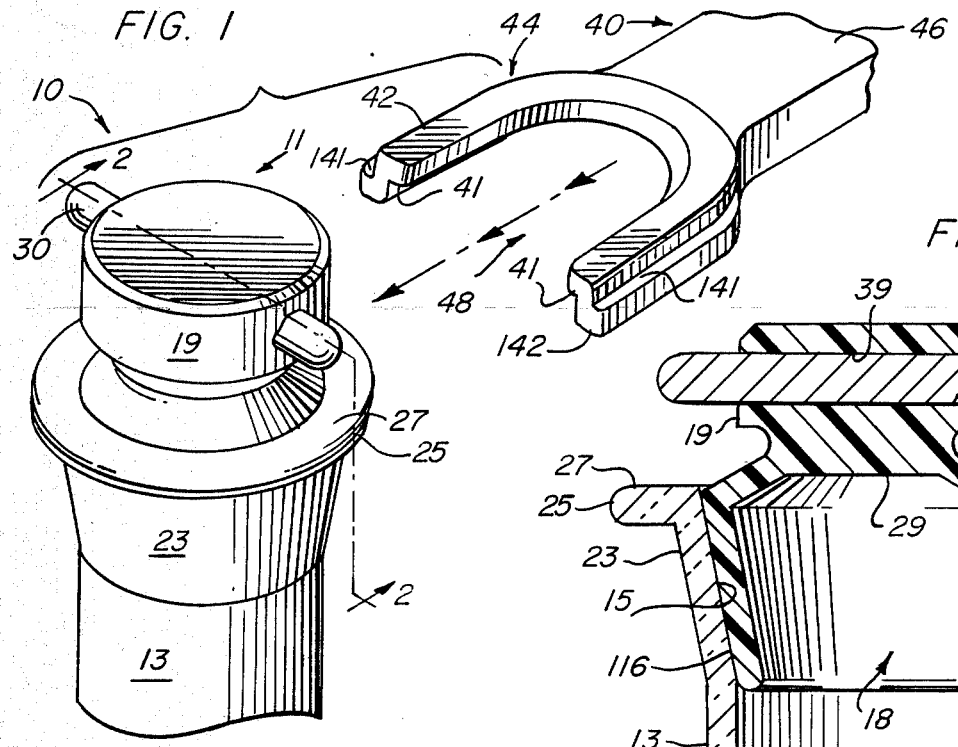
FIG. 1 is a perspective view of the preferred embodiment of the stopper and removal tool of the present invention.

Referring to FIG. 1 of the drawings, reference numeral 10 indicates in general the stopper and removing tool of the present invention. The stopper is indicated generally by reference numeral 11 and is shown mounted in a bottle neck of a glass container. The glass container 13 has an outwardly tapered neck 23 extending upwardly therefrom which terminates in a radially extending flange 25. The flange 25 has an upper bearing surface 27 thereon.

Figure 2:
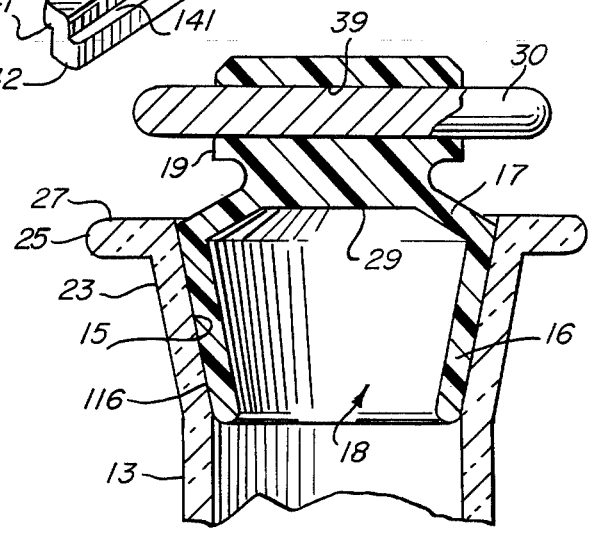
FIG. 2 is a cross-section taken generally along lines 2—2 of FIG. 1.

In FIG. 2, the tapered stopper 11 is shown fitted into the tapered inside portion 15 of the bottle 13. The head portion 19 of the stopper 11 is fitted with a handle 30. The handle 30 comprises an elongated pin with rounded ends 130 which fits into the traverse aperture 39 in the head portion. The lower portion of the stopper is hollowed out area 18 to form thin walled sections 16 and 17. The thin wall section 16 is the lower most portion which forms the sealing wall portion of the stopper against the tapered portion 15 of the bottle neck. Since this conical sealing wall is thin enough to be flexible, the accuracy of matching the respective tapers of the wall and the container in order to produce a good seal is less important. The upper wall of the hollowed out area 18 is formed by an angular conical portion 17. The importance of the shape of this portion is that it results in a structurally weak portion. In making the sealing portion 16 of the stopper a tapered conical portion which is a thin section and thus a flexible surface, is that it also aids in the removal of the stopper since any movement of the sealing portion 16 will more easily break the seal and make the stopper easier to remove. By forming the stopper with the hollowed out area 18, and with the shaped depicted by walls 16 and 17, these areas are so weak that excessive pressure due to expansion cannot be exerted upon the glass bottle sufficient to break it.

The removing tool 40, as shown in FIG. 1, has a handle 46, a head 44 with a cut out recess 48, and flat portions 42, 142 on opposite sides of the dual tines 34. Grooves 41, 141 are provided on opposite sides of the tines so that in cross section (see FIG. 3) each of the tines have back to back double right angle grooves. The purpose being so the same tool can be used with both stopper embodiments.

Figure 3:
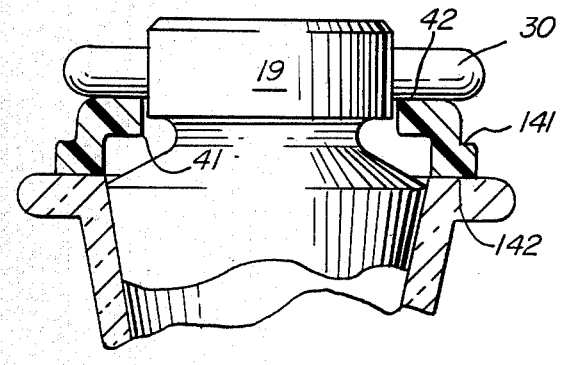
FIG. 3 is a fragmentary portion in side elevation and partly in cross-section, of the stopper/tool of FIG. 1 with the tool in place for assisting in removal of the stopper from the tapered neck of a glass container.

In FIG. 3, the tool is shown in position on the top lip 27 of the bottle flange 25. The U-shaped cut out recess 48 in head 44 is slightly tapered from front to back so that it will fit several sizes of outside diameters of the head portion 19 of the stopper 11. The dimensions are arranged so that when the cut out portion 48 is in contact with the head portion 19, the level flat portions 142 of the tool is in position to contact the top lip 27 of the bottle 13. The circumferential edge of the top lip 27 and flange 25 of the bottle is used as a fulcrum. The handle 30 is preferably made of plastic material. By using the lever 40, a large force can be developed to pry the stopper 11 from the bottle 13.

Figure 4:
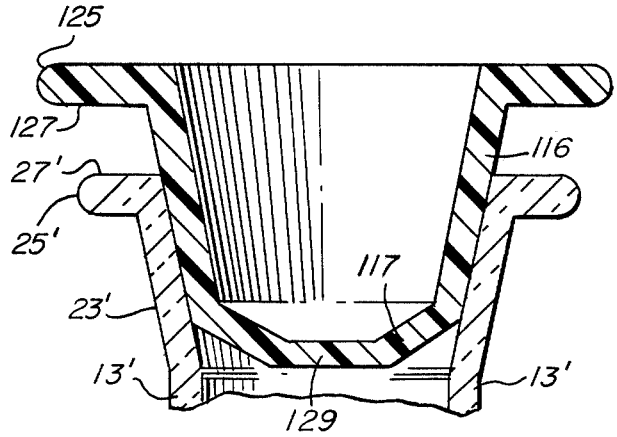
FIG. 4 is a cross-sectional view depicting a modified embodiment of the stopper of the present invention.

FIG. 4 shows a variation of the stopper in which the principle is the same as the first embodiment, but the domed section 129 is reversed. In this case, the handle 30 is replaced with a circular flange 125.

Figure 5:
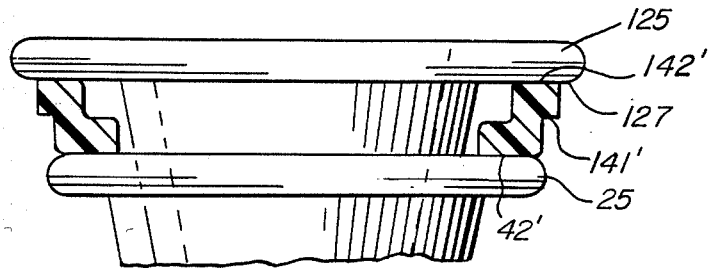
FIG. 5 is a side elevational view of the FIG. 4 embodiment with the tool of FIG. 1 reversed and in place for assistance in removal of the stopper of this embodiment.

FIG. 5 shows the removal tool 46 turned over and with the flange 25 of the bottle as the fulcrum and the flange 125 of the stopper receiving the force from the lever 40. The faces 142, 42 of the tool are shown turned over from the showing in FIG. 3, and because of the back-to-back right angle grooves 41', 141', properly fit the larger tapered walls of stopper 11'.

Again, as in the first embodiment, the walls 116, 117 of the second embodiment which are conically tapered inwardly from the flange 125, are flexible and provide benefits similar to those of the first embodiment. The domed portion 129, in conjunction with the greatly tapered conical wall 117, completely close the interior area 18' of the second embodiment in the same manner that the head portion 19 does for the first embodiment.

With both embodiments, the dual purpose tool 40 is very useful for exerting the necessary leverage force to easily remove a stopper which has been partially glued or stuck into a bottle neck of a glass container.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A stopper device comprising: a one-piece unit having means for efficient sealing with a bottle without danger of breaking same including an upper portion and a bottle neck engaging lower portion;

means with said lower portion for forming a flexible sealing surface of such a configuration that said sealing surface is not in substantial compression;

said flexible sealing surface being on a wall portion of substantially uniform thickness without any slits, slots, ribs, valleys, or the like; and further means provided with said upper portion for permitting easy removal of the device from a bottle neck device when desired; and further including a stopper removal tool having a substantially U-shaped engaging recess at one end thereof and a handle portion at the other end thereof for manipulation by a user, and said tool having means so it can be used with different styles of stoppers;

said means so the tool can be used with different styles of stoppers includes the U-shaped recess of the tool defining two spaced tines with each tine in cross-section having double angles back to back to each other so that an inner portion of said U-shaped stopper engaging will have a recessed area completely therearound and each of the outer surfaces of the respective tines of the U-shaped portion will have complementary recesses extending longitudinally therealong.

2. A stopper device as set forth in claim 1, wherein said means with said lower portion for forming a flexible sealing surface includes double conical tapered walls, said first conical tapered wall extending divergingly from said upper portion, and said second tapered conical wall extending inwardly from the outer circumference of said first conical wall.

3. A stopper device as set forth in claim 2, wherein the interior area of said stopper as defined by said flexible double conical tapered walls is hollow.

4. A stopper device as set forth in claim 2, wherein said further means with said upper portion for permitting easy removal of the device includes a longitudinal pin inserted through an aperture traversely of said upper portion for forming a removing handle for said stopper.

5. A stopper device as set forth in claim 1, wherein said means with said lower portion for forming a flexible sealing surface includes a reversed conical tapered wall extending inwardly from said upper portion, and further includes the lower end of said inwardly tapered conical wall being closed.

6. A stopper device as set forth in claim 5, wherein the interior area of the stopper as defined by said tapered conical wall is hollow.

7. A stopper device as set forth in claim 5, wherein said further means provided with said upper portion for permitting easy removal of the stopper includes a radially extending flange extending outwardly from the upper portion of the device adjacent said first conical tapered wall portion opposite the closed end thereof.

8. A stopper device as set forth in claim 1, wherein said further means with said upper portion for permitting easy removal of the device includes a longitudinal pin inserted through an aperture traversely of said upper portion for forming a removing handle for said stopper.

9. A stopper device as set forth in claim 1, wherein said further means provided with said upper portion for permitting easy removal of the stopper includes a radially extending flange extending outwardly from the upper portion of the device for engagement by a stopper removing tool.

* * * * *